United States Patent [19]

Wilson et al.

[11] 4,281,615

[45] Aug. 4, 1981

[54] SELF-PROPELLED SEMI-SUBMERSIBLE SERVICE VESSEL

[75] Inventors: John H. Wilson, Richardson; Dillard S. Hammett, Dallas, both of Tex.

[73] Assignee: Sedco, Inc., Dallas, Tex.

[21] Appl. No.: 845,831

[22] Filed: Oct. 31, 1977

[51] Int. Cl.[3] ..... B63B 35/44

[52] U.S. Cl. ..... 114/265

[58] Field of Search ..... 114/61, 125, 264, 265, 114/258, 270, 151, 144 B; 9/34; 169/43, 46, 47, 54, 69; 405/195, 196, 200

[56] References Cited

U.S. PATENT DOCUMENTS

| | | | |
|---|---|---|---|
| 3,109,185 | 11/1963 | Miller | 9/34 |
| 3,550,547 | 12/1970 | Pleuger et al. | 114/151 |
| 3,616,773 | 11/1971 | Lloyd | 114/265 |
| 3,685,305 | 8/1972 | Lloyd | 114/265 |
| 3,704,596 | 12/1972 | Lloyd | 114/265 |
| 3,771,481 | 11/1973 | Goren et al. | 114/265 |
| 3,815,682 | 6/1974 | Chiasson et al. | 169/69 |
| 3,835,800 | 9/1974 | Lloyd | 114/61 |
| 3,874,314 | 4/1975 | Sanders | 114/61 |
| 3,915,108 | 10/1975 | Rodriguez | 114/125 |
| 4,091,760 | 5/1978 | Lloyd | 114/265 |

*Primary Examiner*—Trygve M. Blix
*Assistant Examiner*—Jesús D. Sotelo
*Attorney, Agent, or Firm*—Hubbard, Thurman, Turner, Tucker & Glaser

[57] ABSTRACT

A self-propelled semi-submersible column stabilized service vessel for tending offshore production and drilling operations is disclosed. The vessel includes a pair of submersible hulls having ballast compartments for controlling the buoyancy of the hulls. A rectangular service deck or platform which includes fire fighting equipment, rig inspection equipment, repair facilities, and load lifting equipment is supported by means of vertical stability columns which are compartmented and include ballast chambers for controlling the buoyancy of the columns. The fire fighting equipment includes an extendable fire boom for clearing debris and for positioning explosives on the deck of a burning production or drilling platform. An array of monitors is also provided for establishing a curtain of water for thermally shielding the service vessel and for extinguishing a fire on the platform. The rig inspection equipment includes a diving bell and constant tension hoist apparatus for accurately positioning the diving bell along the sloping underwater structure of an offshore production or drilling platform. The load lifting equipment includes a revolving crane which is strategically located on the bow center line of the service platform. The submersible hulls are provided with fixed in-line propulsion units on each hull and variable heading azimuth thrusters disposed near the bow end of each hull. The main propulsion units and variable azimuth thrusters cooperate with anchor lines under constant tension winch control for accurately positioning the service vessel adjacent an offshore production or drilling platform for transferring supplies and equipment or for fire fighting purposes in moderately heavy seas. The buoyancy of the stability columns and hulls is differentially controlled for maintaining stability and trim during heavy load lifting operations. The buoyancy control features are also utilized in combination with davits and constant tension winch assemblies for lifting submerged pipelines for inspection and repair.

14 Claims, 28 Drawing Figures

PORT ONLY

PORT AND STARBOARD

PORT AND STARBOARD

SELF-PROPELLED SEMI-SUBMERSIBLE SERVICE VESSEL

BACKGROUND OF THE INVENTION

1. Field of the Invention

The present invention is related generally to floating platforms for tending marine operations, and in particular to a column stabilized, self-propelled semi-submersible vessel for servicing offshore petroleum production and drilling operations in severe ocean environments.

2. Description of the Prior Art

As energy demands increase, so does the need to explore and produce petroleum from offshore areas in deep and rough waters. Of vital concern to such offshore petroleum production operations is the need for adequate measures to be taken to minimize the effects of blowouts, fire and spills. There is a continuing interest in the advancement of concepts and equipment to adequately handle such offshore disasters in the rougher and deeper waters of the world.

With the development of major oil and gas offshore production facilities in new areas such as the North Sea, attention has been focused on the rough weather performance of existing heavy duty offshore work vessels. Weather conditions which are characteristic of the North Sea require a service vessel to exhibit sustained speed in a seaway, maneuverability, and stable sea keeping ability. For a work vessel operating in open water, seakeeping ability is a prime requirement, yet when the sea state rises over a mild chop, most conventional offshore work vessels are unable to maintain speed without severe pounding, pitching and rolling, which damages both cargo and vessel and makes travel uncomfortable for those aboard.

On location, stability is essential, because it is often difficult if not impossible to safely unload cargo from a rolling, pitching supply vessel onto a drilling or production platform. Experience has shown that considerable time is frequently lost, at a very high cost per hour, in delivering supplies and equipment to offshore platforms while waiting for weather conditions to improve. It is not unusual, for example, from North Sea supply and support operations to be curtailed as much as 25 percent of the time, due to adverse sea conditions. Also, in servicing underwater construction and salvage operations, a serious operational problem results from operating a diving bell from an unstable platform. When the diving bell rolls during launch and recovery, it causes difficulties to the diving personnel in the diving capsule. For this reason diving operations from standard supply and support vessels have been restricted to sea conditions no worse than sea state 5.

With the increased exploration and production activity, the construction of fixed production facilities has increased towards deeper waters. In the North Sea, for example, many major producers have installed platforms in over 200 to 400 feet of water. There is an increasing concern about the ability of the producers to cope with and provide services for disasters which occur in such deep and rough water environments. Although effective steps have been taken to prevent offshore blowouts and fires, there still exists the possibility of a disaster occurring in relatively deep waters.

According to a conventional procedure for coping with such deep water disasters, such as an offshore fire, a "work platform" is supported on the ocean floor at a fixed elevation adjacent to a drilling platform on which a blowout has occurred or which is on fire. The work platform provides a deck area from which debris can be cut away, the fire extinguished, and the well head shut off and capped. The practice of setting up such a work platform next to a burning production platform in such deep and rough water is clearly impractical from the standpoint of the time and expense involved. Studies which have compared operations in relatively calm waters such as those of the Gulf of Mexico and with relatively deep rough waters such as the North Sea have found that seas of six feet or higher occur less than five percent of the time in the Gulf, while in the North Sea, waves of these heights occur more than thirty five percent of the time generally and in some areas more than seventy percent of the time. Conventional barge equipment used to fight a fire and install a work platform cannot operate in seas greater than six feet. Therefore there is a serious and urgent need for a service vessel which can operate effectively in relatively rough seas.

SUMMARY OF THE INVENTION

A self-propelled semi-submersible column stabilized service vessel for tending offshore drilling operations in a relatively severe ocean environment is disclosed. The vessel includes a pair of submersible hulls having ballast compartments for controlling the buoyancy of the hulls. A rectangular service platform or deck is provided which includes fire fighting equipment, rig inspection equipment, repair facilities, and load lifting equipment. The service platform is supported by vertical stability columns which are compartmented and which include ballast chambers for controlling the buoyancy of the columns. The fire fighting equipment includes an extendible fire boom for clearing debris and for positioning explosives on the deck of a burning production or drilling platform. An array of monitors is also provided for establishing a curtain of water for thermally shielding the service vessel and for extinguishing a fire on the platform. The rig inspection equipment includes a diving bell and constant tension hoist apparatus for accurately positioning the diving bell along the sloping underwater structure of an offshore drilling platform. The load lifting equipment includes a revolving crane which is strategically located on the bow center line of the service platform. The submersible hulls are provided with fixed in-line propulsion units on each hull and variable heading azimuthing thrusters disposed near the bow end of each hull. The main propulsion units and variable azimuth thrusters cooperate with anchor lines under constant tension winch control for accurately positioning the service vessel adjacent an offshore platform for transferring supplies and equipment or for fire fighting purposes in moderately heavy seas. The buoyancy of the stability columns and hulls is differentially controlled for maintaining stability and trim during heavy load lifting operations. The buoyancy control features are also utilized in combination with davits and constant tension winch assemblies for lifting submerged pipelines for inspection and repair.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DESCRIPTION OF THE PREFERRED EMBODIMENT

Figure 1:
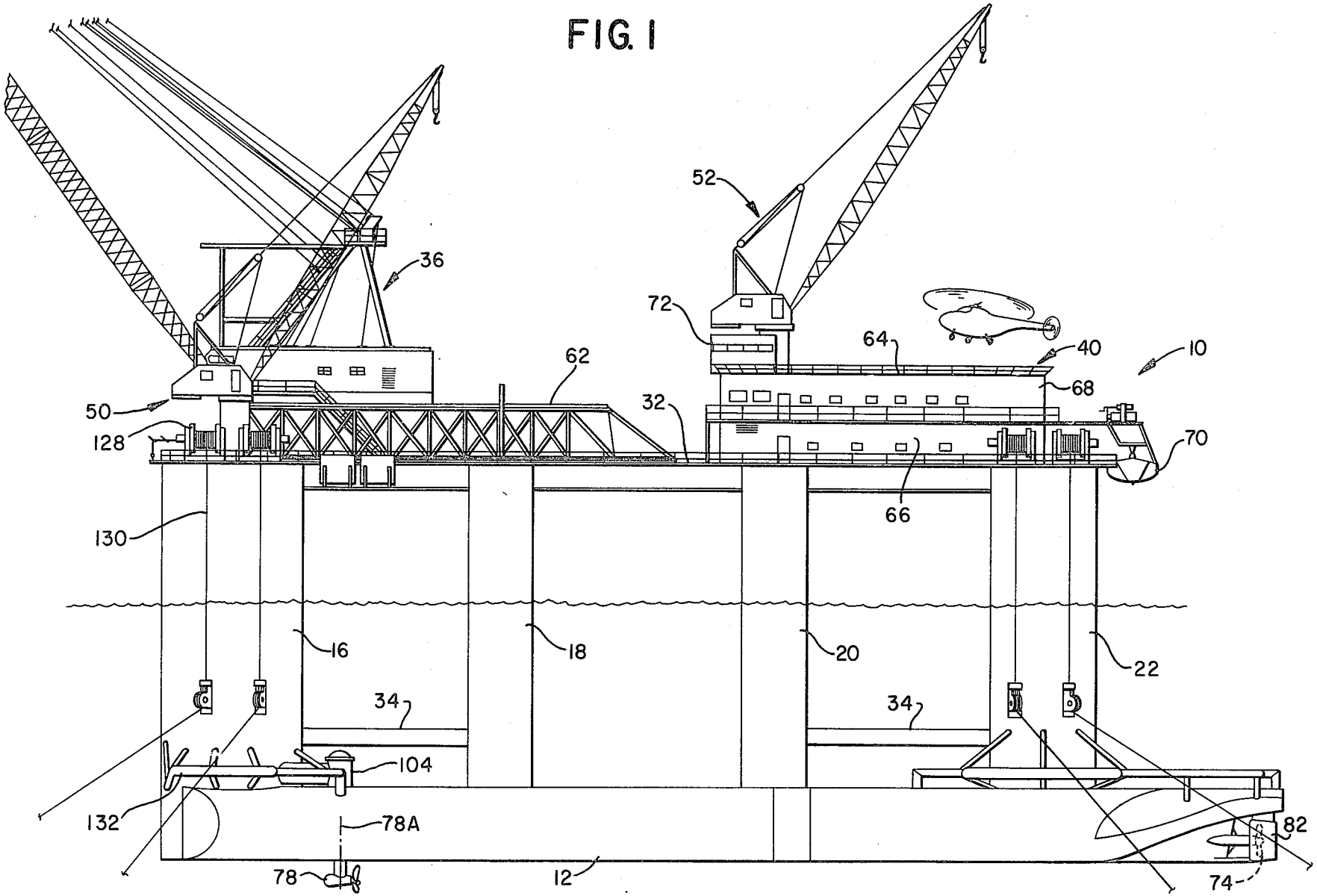
FIG. 1 is a port profile elevation view of a semi-submersible service vessel constructed according to the teachings of the present invention.
Figure 2:
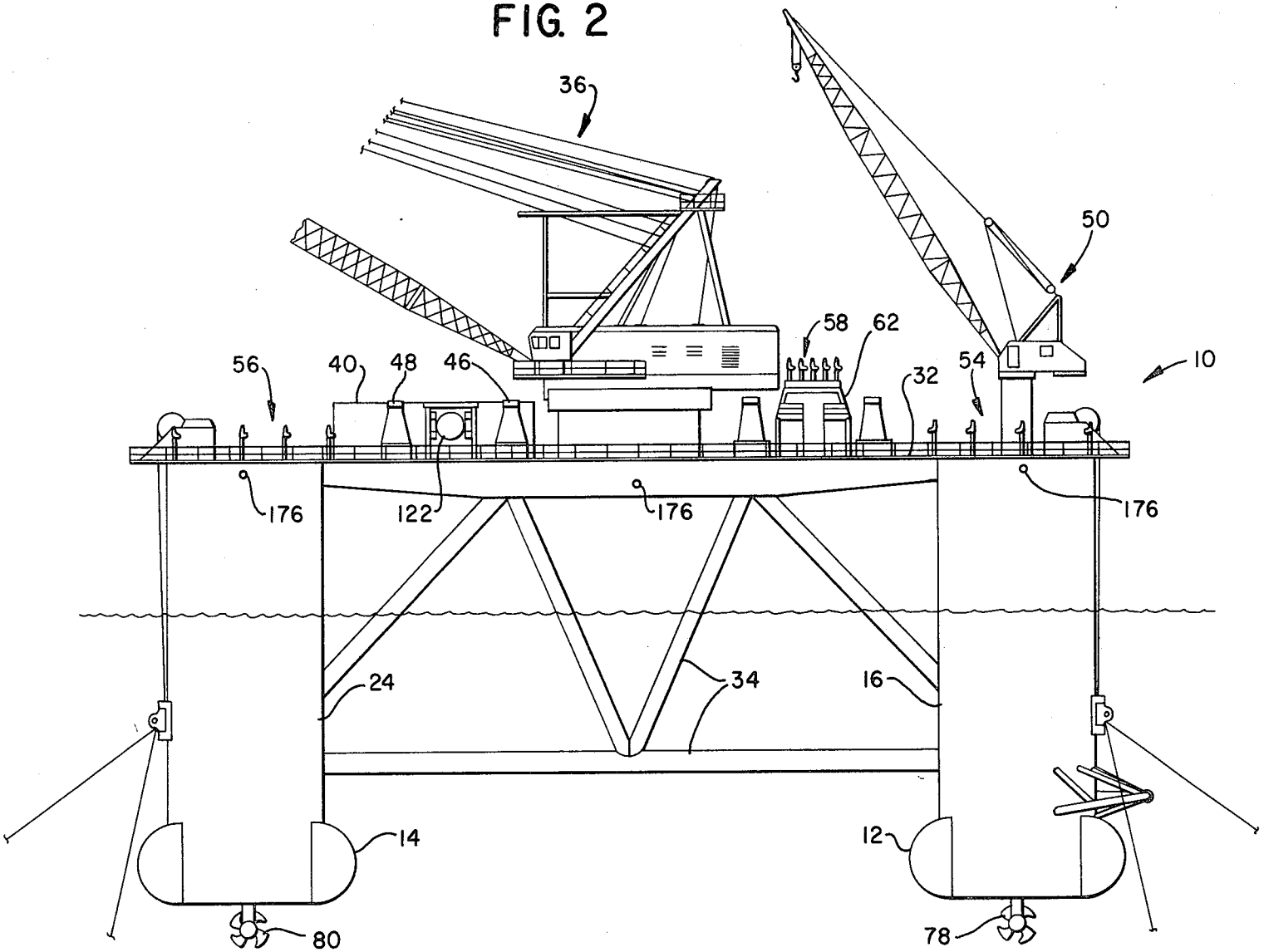
FIG. 2 is a forward profile elevation view of the semi-submersible service vessel shown in FIG. 1.

Referring now to the drawing, the invention is embodied in a self-propelled semi-submersible column stabilized service vessel 10 the general features of which are illustrated in FIGS. 1 and 2 of the drawing. The service vessel 10 is generally rectangular in construction, twin hulled, column stabilized, self-propelled semi-submersible type utility service vessel which is properly constructed and equipped for extended operations and relatively deep and rough waters such as the North Sea production fields.

The semi-submersible feature is provided by the buoyancy of two oval hulls 12, 14 and eight stability columns 16, 18, 20, 22, 24, 26, 28 and 30. The stability columns 16, 22, 24 and 30 are relatively large diameter columns and the columns 18, 20, 26 and 28 are relatively small diameter intermediate stability columns. The four large columns and four intermediate columns constitute the stability members and also support a main service deck 32. The large diameter port and starboard stability columns 16, 24 are preferably 40 feet in diameter, while the aft stability columns 22, 30 are preferably 30 feet in diameter. The port intermediate stability columns 18, 20 and starboard intermediate stability columns 26, 28 are preferably 18 feet in diameter.

Tubular trusses 34 run transverse with respect to the hulls between each pair of columns. These trusses provide additional support for the deck 32 as well as providing the structure for tying the hulls 12, 14 and columns together into a mechanically stable structural system.

The deck 32 is generally rectangular in outline and is arranged with a large capacity revolving crane 36 mounted in a turret crane tub 38 on the forward centerline while a deck house 40 with shops, generators, controls and quarters is located aft. Other main deck facilities include four davit cranes 42, 44, 46 and 48 mounted at the bow, and two utility pedestal cranes, one indicated by the reference numeral 50 mounted over the forward port corner column 16, and another indicated by the reference numeral 52 mounted above the roof level at the forward starboard corner of the building over the after 18 foot diameter stability column 28. Fire fighting monitors are mounted in a port array 54, a starboard array 56, and a fire boom array 58 forward of the deck 32.

Diving facilities 60 are located to starboard of the revolving crane 36 and an extendible fire boom assembly 62 is mounted to the port side of the revolving crane 36. The after deck house is a two-story structure, which includes a main deck level 66 which contains a quarters area, machine shop area, machinery area and engine room. An upper level 68 includes an upper deck quarters area, a control room area, and a switch gear room. Life boats 70 are also located aft. An additional control room 72 is located at the roof level of the upper deck 68.

Propulsion machinery located in each hull 12, 14 comprise conventional screw propellers 74, 76 located at port and starboard, respectively, at the extreme aft portion of each hull, and an azimuthing thruster assembly 78, 80 at port and starboard, respectively. The screw propellers 74, 76 are located at the extreme aft position in line on each hull and are preferably enclosed by conventional kort nozzles 82, 84. The hulls 12, 14 contain the propulsion motors, ballast compartments, fuel oil and pump rooms. The columns and hulls are compartmented for damage control contingencies and to provide for differential ballasting for trim and heavy load operations. As will be discussed in detail thereinafter, three compartments in each of the intermediate and one compartment in the aft stability columns are used for ballast purposes. Void spaces at the upper column compartments may be used for miscellaneous storage. Potable water tanks are located in the aft column adjacent to the quarters area.

In the preferred structure, the lower hulls 12, 14 are spaced apart preferably by a distance of 195 feet, center to center. The four columns on each hull are spaced at 75 foot centers and extend vertically at a constant diameter from the top of the hull to the main deck level. The tubular truss members 34 are arranged according to conventional triangular truss load configuration in horizontal and vertical planes to complete the mechanical structure. The transverse horizontal truss members are preferably six feet in diameter and are free flooding. The horizontal diagonal and longitudinal truss members are preferably 4½ feet and 3 feet in diameter, respectively, and are buoyant. The truss members and the vertical planes are preferably five feet and four feet in diameter, respectively, and are buoyant.

Figure 5:
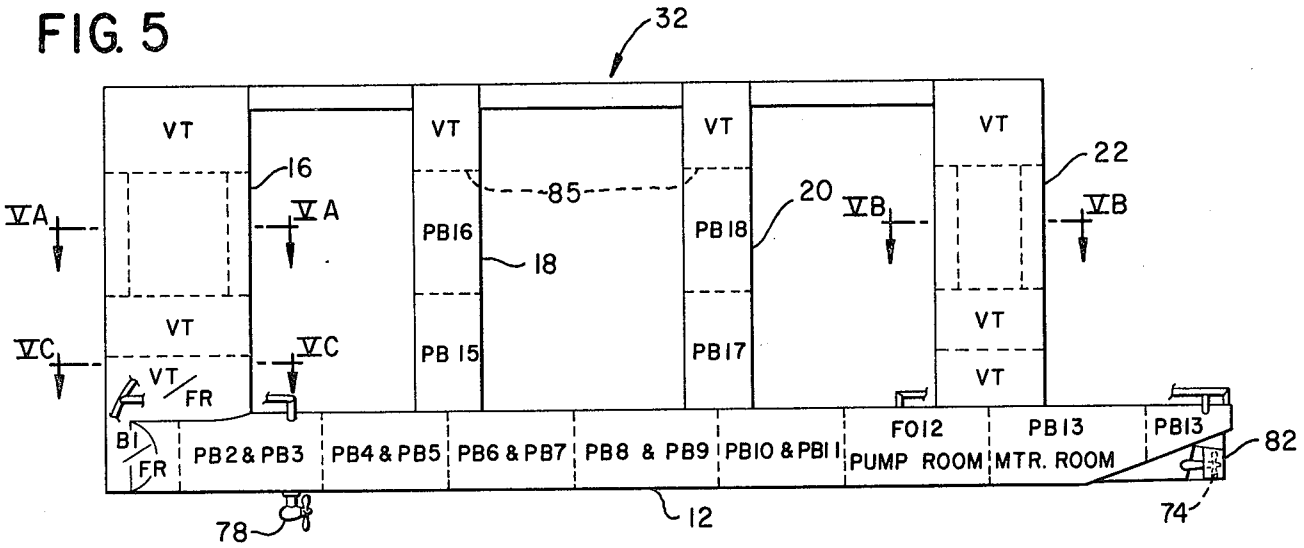
FIG. 5 is a port elevation view of the semi-submersible service vessel which illustrates a preferred compartmentation arrangement for the stability columns and hulls.
Figure 5C:
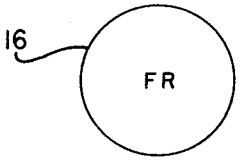
FIG. 5C is a sectional view of the port forward stability column taken along section C—C of FIG. 5.
Figure 5B:
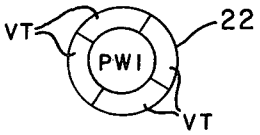
FIG. 5B is a sectional view of the port aft stability column taken along section B—B of FIG. 5.
Figure 5A:
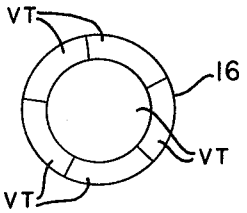
FIG. 5A is a sectional view of the port forward stability column taken along section A—A of FIG. 5.
Figure 6:
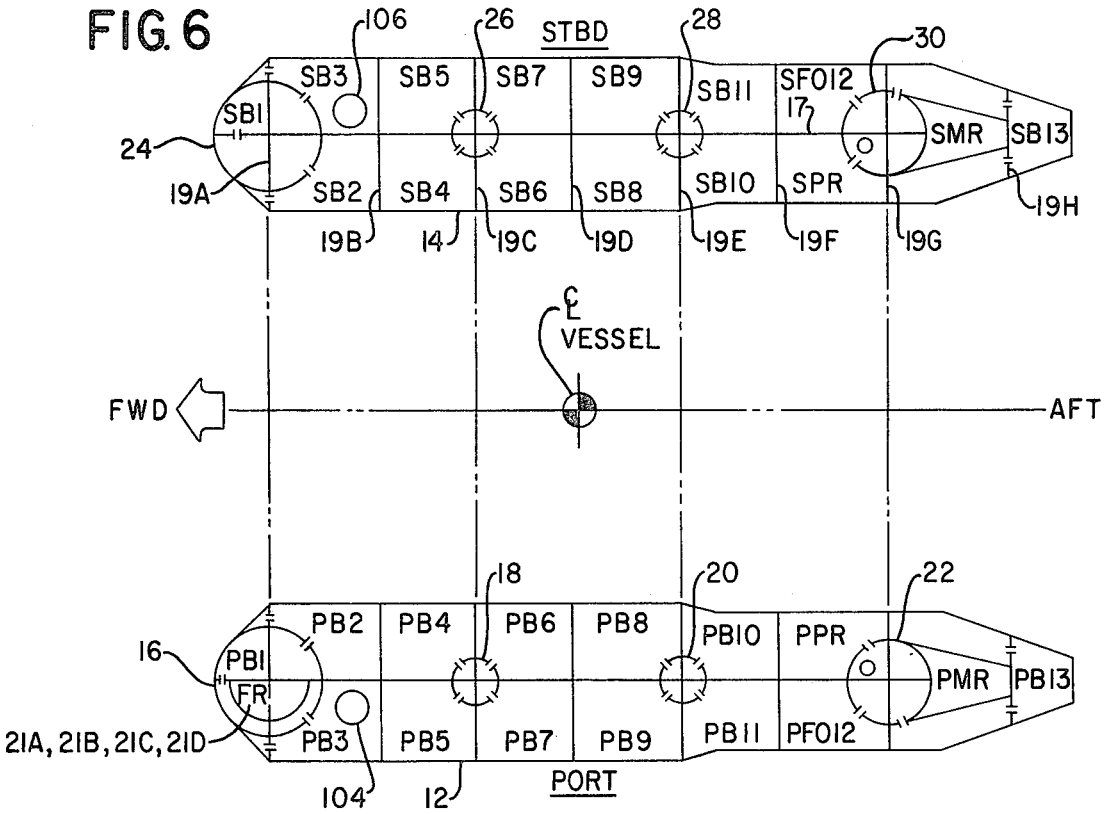
FIG. 6 is a plan view of the submersible hulls of the semi-submersible service vessel which illustrates a preferred compartmentation arrangement.

Each hull 12, 14 is subdivided into compartments for ballast, fuel oil, ballast pump rooms and motor propulsion rooms. The fire pump room is located in the port hull forward at the base of the 40 foot stability column. Referring now to FIGS. 5 and 6, the compartmentation of the hulls and stability columns is illustrated. In particular, the port hull 12 includes port ballast compartments PB1–PB13, a fire pump room FR, a port pump room PPR, a port fuel oil tank PFO disposed in tank location 12, and a motor room designated MR. The starboard hull is similarly compartmented with starboard ballast tanks SB1–SB13, a starboard fuel oil tank in tank location 12, a starboard pump room designated by SPR, and a starboard motor room SMR. The large diameter forward stability columns are bouyant void tanks, and the forward port stability column includes a fire pump room designated by the symbol FR. The intermediate port stability columns 18, 20 and the intermediate starboard stability columns 26, 28 are compartmented by transverse bulkheads 85 vertically stacked to include a void tank and two ballast tanks PB15-16 and PB17-18 in the port intermediate stability columns and SB16–SB18 in the starboad intermediate stability columns. Sectional views which illustrate the compartmentation of the stability columns are shown in FIGS. 5A–5C. Potable water tanks PW and SW are concentrically disposed within the aft stability columns 22, 30 as can best be seen in the sectional view illustrated in FIG. 5B.

The starboard hull 14 is subdivided into 15 compartments by one longitudinal bulkhead 17 and eight transverse bulkheads 19A–19H. The port hull 12 is subdivided similarly except it has one additional semi-cylindrical bulkhead isolating the external fire fighting pump room. The compartments common to both hulls are 12 salt water ballast tanks, one fuel oil tank, a pump room, and a trapozoidal shaped motor room. Two of the transverse bulkheads and the oblique bulkheads enclose the motor room. The two spaces flanking the motor room and the space aft are interconnected to form a single salt water ballast tank.

Figure 19:
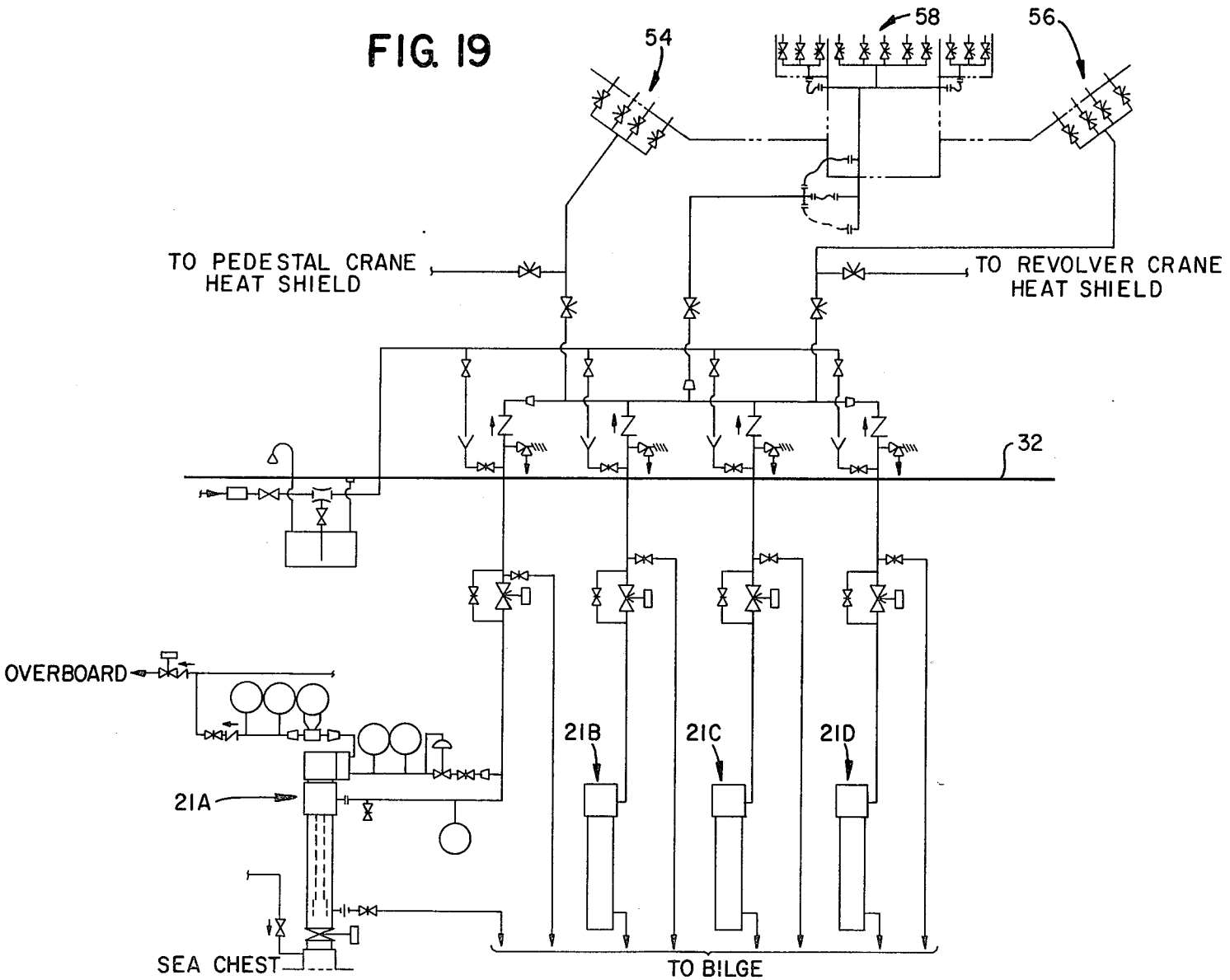
FIG. 19 is a schematic diagram which illustrates the interconnection of the fire pumps and monitors.

The fire pump room FR of the forward port column 16 has four deep well fire pumps 21A–21D, with motors at a higher elevation, providing independent suction through sea chests, as typified in FIG. 19, for discharge through monitors 54, 56 and 58 on the service deck 32. Each pump is preferably rated at 10,000 GPM. The location of the fire pumps in such a low elevation location provides increased head when the vessel 10 is at a deep draft which is usually the case for fire fighting purposes. Increased head is important since the combined capacity of the monitors may exceed the pump capacity. The relative locations and interconnections of the fire pumps and monitors are illustrated in FIGS. 2, 6 and 19.

Access to the pump room in each hull is provided by an elevator from the main deck 32. Each pump room has two sea chests, one for the ballast system and one for the salt water service system. Each contains pumps, valves, manifolds and piping for the ballast, bilge, salt water and fuel oil systems. The sea chest valves and ballast tank valves are fitted with remote operators. The ballast pumps and bilge pumps are fitted with remote starting. The other valves and pumps are locally operated. A schematic diagram showing a typical interconnection is illustrated in FIG. 7.

Figure 7:
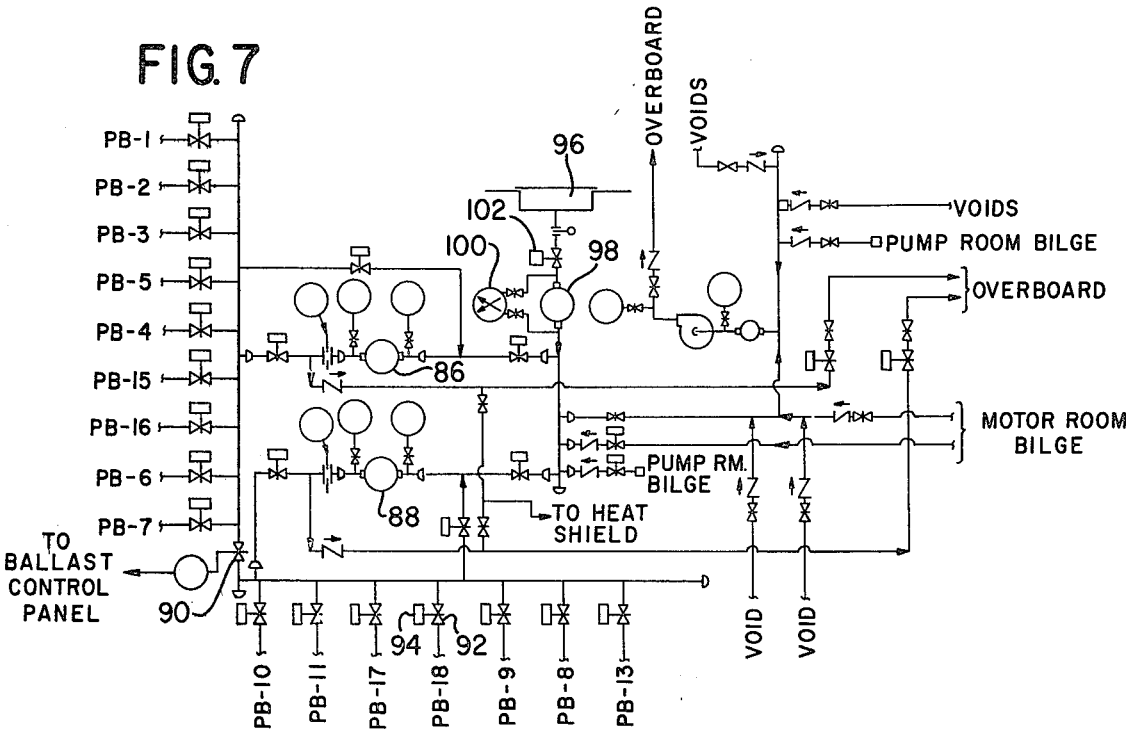
FIG. 7 is a schematic diagram of the port pump room and associated manifold interconnections.

Referring now to FIGS. 5, 6 and 7, two pumps 86, 88 are disposed in each hull, each having the capacity to completely fill or empty the ballast tanks. Each pump is rated at 2500 GPM at 90 foot head which corresponds to a submerged operating depth of 80 foot draft. Both discharge into or take suction from a manifold which can serve all ballast tanks. The manifold valves are fitted with electric motor operators except for manifold block valves 90, which are manually operated and are normally kept closed. The block valve 90 divides the manifold so that one pump serves tanks PB1-7, 15 and 16 and one pump serves tanks PB8-11, 13, 17 and 18. The block valve 90 prevents accidental transfer of ballast between fore and aft tanks when the ballast tank valves are open. Opening the block valve permits either pump to serve all tanks. The ballasting of any particular tank is individually controllable by means of its associated manifold valve 92 which is controlled by an electric motor servomechanism 94. This permits accurate trim adjustments and differential ballasting for accommodating heavy loading operations as will be further described hereinafter.

The ballast tanks are normally filled by pumping into a pair of tanks in each hull. If desired, ballast tanks can be filled by gravity flow instead of pumping. Ballast is admitted through a sea chest 96, a strainer 98 and a suction header 100 to the pumps or directly to the ballast manifold bypassing the pumps. Ballast is discharged by closing the sea chest suction valves, opening the ballast tank suction valves and opening pump discharge lines to the sea. Independent discharge lines are provided from each pump.

The ballast system is fitted with full size direct bilge suctions so that the pump room and motor room can be pumped out in an emergency. The valves are remotely motor operated from the ballast control console. The ballast system is cross-connected to the bilge pump system which may be used to completely strip the water from the ballast tanks. The pumps and piping arrangement is such that the ballast is taken in or discharged only. Ballast cannot be transferred from hull to hull, nor from tank to tank within a hull, nor taken in one tank while discharging from another. The remotely controlled, motor operated manifold valves 92 are either fully open or fully closed. The valves do not stop in a partially open position except for the ballast pump discharge valves which can be opened to any position. The ballast water sea chest valve 102 is air operated and closes automatically in the event of a power failure. The ballast pumps and all valves are operated remotely from a ballast control console located in the aft control room on the upper deck. The control includes a mimic board which shows all tanks, ballasts, potable water and fuel oil. It contains pushbuttons for electrical operation of valves, four ballast pumps, and two bilge pumps. Ballast pump flow indicators with bilge high-low alarms are included. Tank gauging and draft measuring is also provided in the same console.

The semi-submersible service vessel 10 is fitted with the two fixed pitch screw propellers 74, 76 located at the aft end of each hull 12, 14, respectively. The propeller speed is rated at 190 RPM and is regulated from either the aft control room 72 or the forward control room in the crane tub 38. The fixed pitch propellers are ten foot diameter four-blade conventional screws with 120 inches pitch. The starboard propeller is right-handed while the port propeller is left-handed. Steering can be accomplished by differential adjustments in propeller RPM. Each of the propellers is driven by four horizontally mounted, series wound DC electric motors through conventional reduction gearing and shafting. The drive motors, reduction gears, cooling pump and associated equipment are located in the motor room, aft of the pump room, in each lower hull 12,14.

The variable azimuth heading thrusters 78, 80 are fitted on the semisubmersible service vessel 10 near the forward end of each hull 12, 14. The thrusters are electric motor driven and each is fully azimuthing about its vertical axis as indicated by the axis line 78A in FIG. 1. Full thrust can be exerted in any direction. Propeller speed and azimuth heading are regulated from either the forward or the after control room. These thrusters serve as the principal means of steering when the vessel is under way. They are also available to control heading and give directional stability while anchoring, approaching platforms or performing similar maneuvers. Each thruster has a 114 inch diameter, 76 inch pitch, four blade conventional screw propeller which is driven by two series wound DC electrical motors driven through spiral bevel gearing. The azimuth thrusters are not fitted with kort nozzles. The drive motors, azimuthing motors, pumps, blowers and associated equipment are located in capsules 104, 106, respectively, which are accessible for inspection and maintenance. Each of the thrusters may be completely removed for servicing by using the large capacity revolving crane 36.

The propellers 74, 76 and thrusters 78, 80 can be controlled at a propulsion and thruster control console located in both the foward and after control rooms. Dynamic positioning controls are also installed in each control room. Maneuvering and control are accomplished from the forward control room for platform work, pipeline/diving operations, towing and short moves. The after control room 72 is used primarily for ocean voyage transit operations, noncongested waters, or for secondary and emergency control.

The semi-submersible service vessel 10 need not have rudders. In the cruise mode, heading and steering may be controlled by several methods. The stern propeller speeds are adjustable differentially and are individually reversible. In addition, the bow thrusters 78, 80 are capable of full azimuthing and differential speed control. These steering methods can be accomplished by either coordinating control or manual operation.

Substantially identical but completely independent propulsion and thruster control consoles are employed on the semi-submersible service vessel 10. One of the consoles is located forward, in the crane tub 38, while the second console is located aft in the main control room 72. Each console functions as a completely independent control system. All functions of propulsion and thruster control must take place at only one console and may not be divided between consoles. A simple engine order telegraph system links the forward control center with the aft control center, to permit vessel command from the forward station and command execution from the after station. The engine order telegraph does not transmit adequate command information to allow operation of the thrusters independent of the main propulsion system operation. The single engine order telegraph gives all commands necessary since the after control center is controlled by a single fore-aft coordinated throttle.

The propulsion and thruster control center in command is in direct communication with propulsion and thruster switching control system which control the thrusters and main propulsion units. Each of the four screw propellers receive a separate power throttle signal from the switching control system which results in propulsion activity. The two screws making up the main propulsion system additionally receive forward and reverse commands through the propulsion switching control system. The two thrusters propeller screws receive azimuth command signals, clockwise and counterclockwise, through their respective switching control systems. Additionally, each thruster may also receive a momentary reverse command, which will reverse direction of the screw in the command mode of coordinating control, or dynamic positioning only. This momentary reverse command is issued only at the occasion that the thruster is commanded to make a direct reversal, and serves to effectively reduce the reversing time of the thruster. Therefore, the propulsion and thruster control center in command, issues throttle signals for each of the four screws, with the main screws also receiving forward and reverse commands, while the thrusters also receive clockwise and counterclockwise azimuth commands.

The principal operating facilities and quarters are located on or above the main deck 32. The main deck forward has the large capacity revolving crane 36 at the centerline with the forward vessel control room built into a forward portion of the crane tub 38. The diving enclosure facility 60 is located to starboard and the extendible fire boom 62 to port. The fixed fire monitors 54, 56 are installed at the forward edge of the 40 foot diameter stability columns 16, 24, respectively, port and starboard. The special pipe handling davits 42, 44, 46 and 48 project over the forward deck perimeter.

The deck house 40 comprises a two-story structure including quarters 108, a machine shop area 110, an engine room 112, and a machinery room 114. The engine room area 112 houses the main electrical power generation and control equipment, steam generators, water makers, air compressors, water heaters, and $CO_2$ equipment and helideck foam pump. The large machine shop 110 extends inboard to port of the engine house 112 with rollup doors forward to the open deck area. The port side quarters section of the building accommodates ships personnel in single, double and four man rooms and includes a change room, berthing and toilet facilities, galley, mess hall, recreation room, offices, conference rooms, laundry, a small hospital, and food and linen storage, and also the emergency generator and air conditioning systems. The hospital may be expanded by reducing the normal amount of quarters berth space. A radio room is located on the upper deck level 68. The heliport area 64 is located on the roof of the quarters section and is capable of landing a wheeled helicopter. A rectangular moon pool opening 116 with flush portable cover is located on the center line midship.

The large capacity revolving crane 36 is powered by an independent diesel drive. Its rated lift capacity varies inversely with respect to its reach. The primary function of the revolving crane is for off-loading heavy loads onto the deck of an offshore drilling platform. The pedestal cranes 50, 52 are provided for routine lifts between service boats, platforms and the main deck and for movement of equipment about the vessel. The port pedestal crane 50 is preferably electrically driven and the starboard pedestal crane 52 is preferably diesel engine powered. The diesel powered pedestal crane 52 serves the main deck area in front of the machine shop rollup doors, the machine shop hatch, and the moon pool 116. It also serves for routine lifts from supply vessels and for launching of the rescue boats 70.

Figure 8:
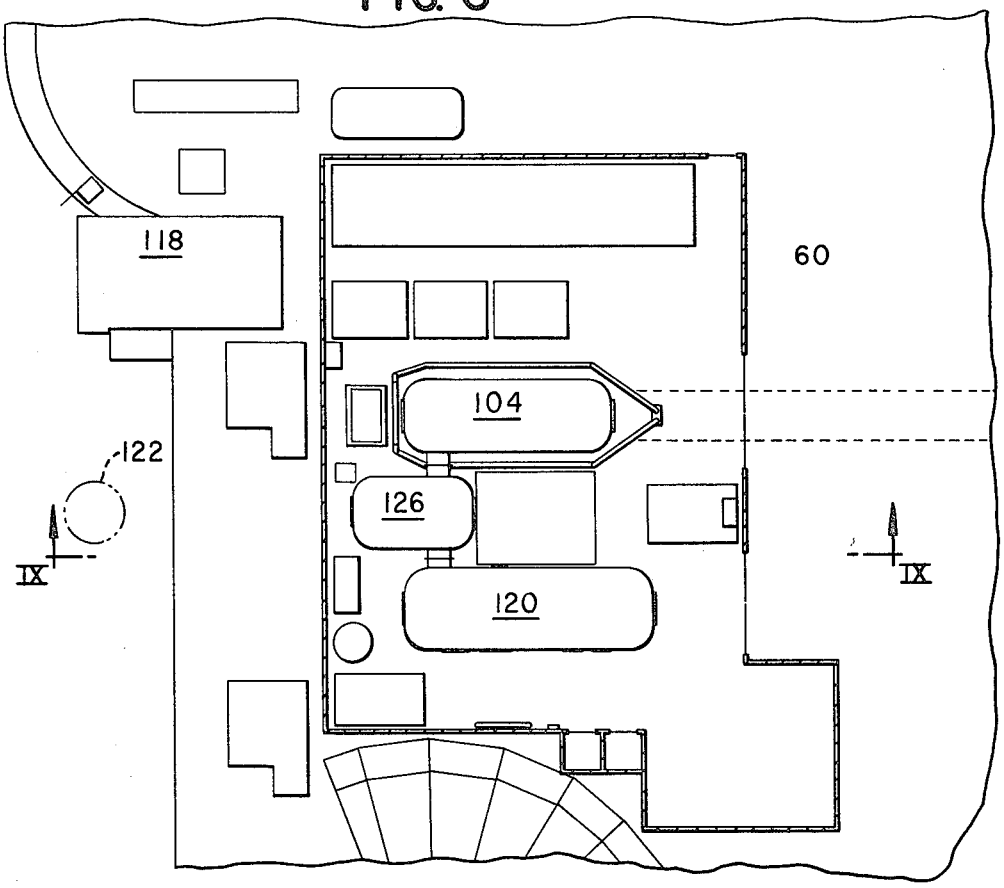
FIG. 8 is a plan view of the diving facility of the semi-submersible service vessel shown in FIG. 1.
Figure 9:
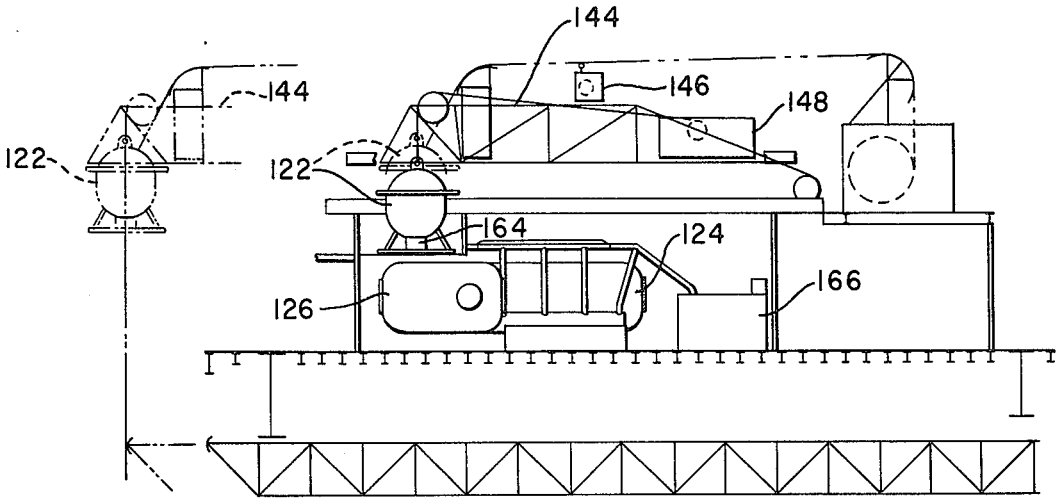
FIG. 9 is an elevation view, partly in section, of the diving facility taken along section IX—IX of FIG. 8.

Two complete diving systems are located on the main deck within the diving facilities enclosure 60. Referring to FIGS. 8 and 9, these systems are embodied in the air dive system 118 and the saturation dive system which includes a saturation chamber 120, a diving bell 122, a lifeboat chamber 124, and a transfer chamber 126 for removing personnel from the diving bell 122 into either the saturation chamber or the lifeboat chamber under controlled atmosphere conditions. The air dive system is conventional and is limited to water depths of 150 feet. The saturation dive system of the present invention is normally used at deeper depths to 350 feet maximum. Operation of these systems will be described in detail hereinafter.

Figure 3:
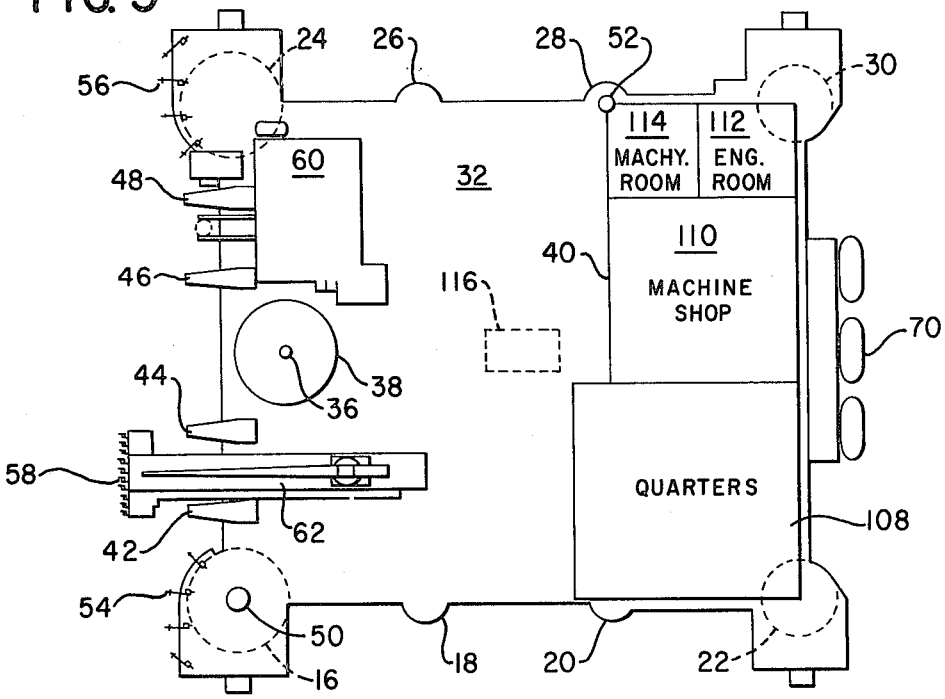
FIG. 3 is a plan view of the service deck or platform of the semi-submersible service vessel shown in FIG. 1.
Figure 4:
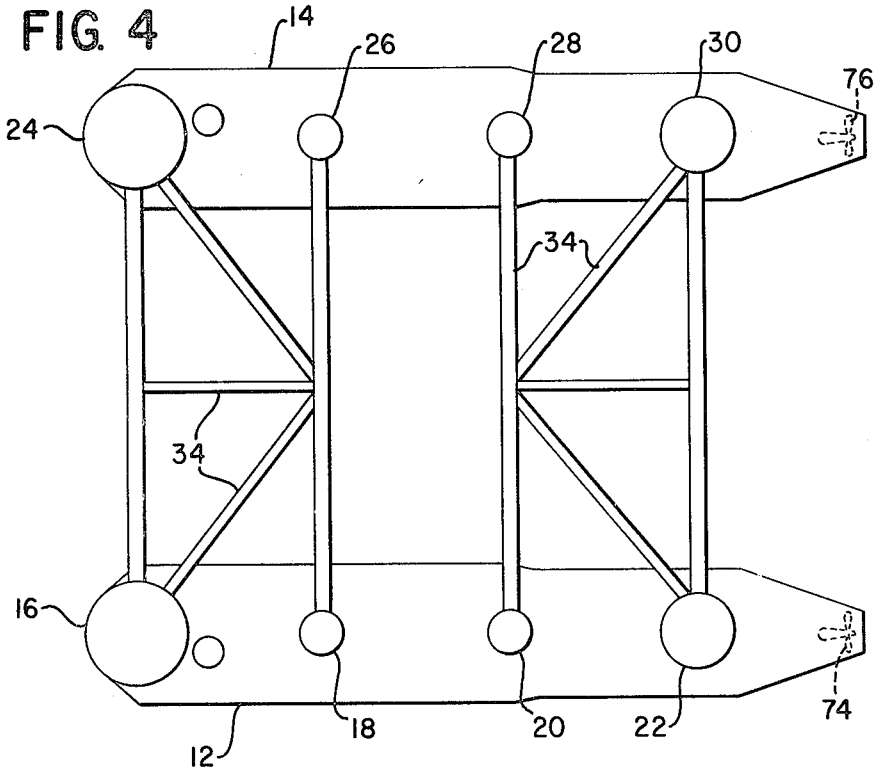
FIG. 4 is a plan view of the submersible hulls and truss interconnection structure of the semi-submersible service vessel shown in FIG. 1.
Figure 18A:
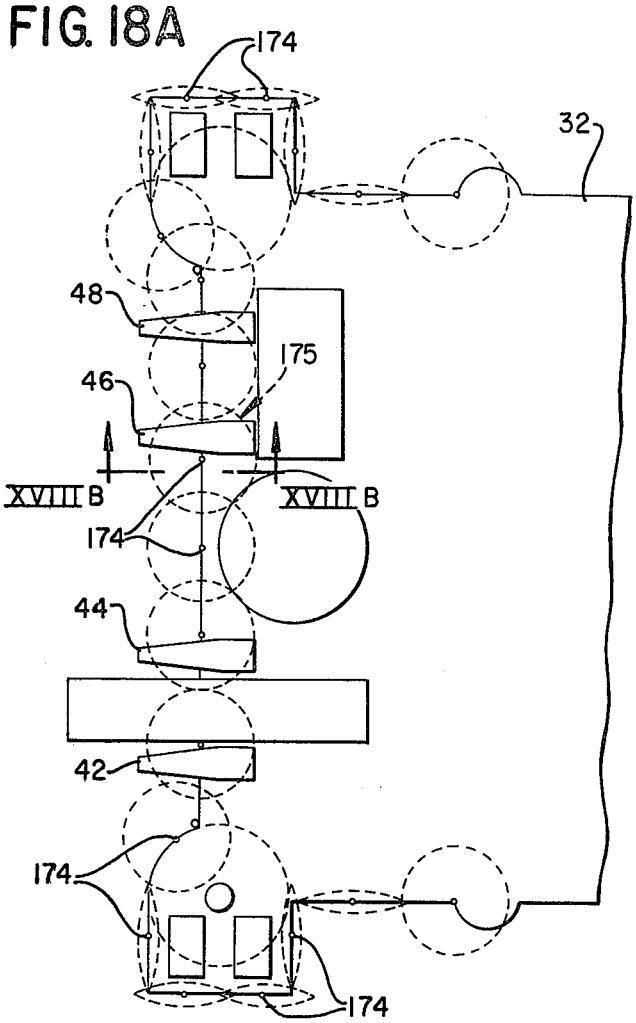
FIG. 18A is a plan view of the forward deck of the semi-submersible service vessel which illustrates the location of the heat shield system.
Figure 18B:
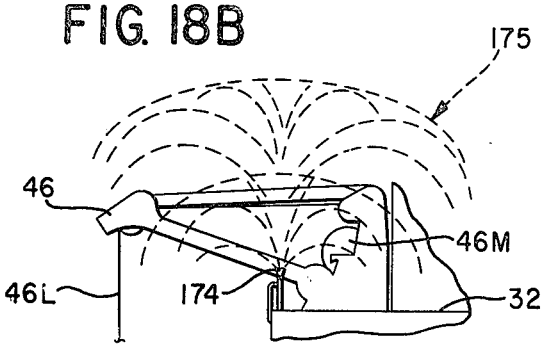
FIG. 18B is an elevational view of a spray nozzle of the heat shield system of FIG. 18A which illustrates a preferred spray pattern.

The semi-submersible service vessel 10 is equipped to conduct pipeline inspection and repair operations. The principal equipment to support this type of work includes the saturation diving system previously described, the set of four pipeline davits 42, 44, 46 and 48, and jetting capacity for uncovering and breaking loose a buried pipeline. The four davit cranes 42, 44, 46 and 48 are located across the bow as shown in FIGS. 2 and 3 of the drawing. Each of the davit cranes 42, 44, 46 and 48 includes a winch line and an electrically driven motor for maintaining a constant level of tension in each winch line during a pipeline lifting and repair operation. An example of this arrangement is shown in FIGS. 2, 18A and 18B, where a winch line 46L is coupled in reeved engagement to the davit crane 46, and is tensioned by an electric drive motor 46-M. A five foot wide work platform in front of the davits facilitates the assembly of up to 150 foot long pipe sections. Lines from the davits can be attached to an existing pipeline on the ocean floor so that the pipeline can be raised and held in a stable position at the mud line for inspection and repair as necessary. The davits can also accommodate large pipeline repair sleds. Water jetting capabilities are provided by the four 10,000 GPM fire pumps located in the port hull 12. Air jetting capability is also provided by auxiliary air compressors.

Figure 10:
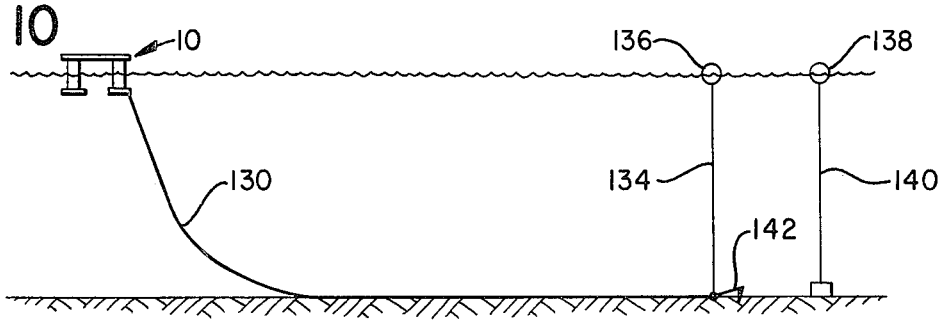
FIG. 10 is an elevation view which illustrates a preferred mooring line arrangement.
Figure 11:
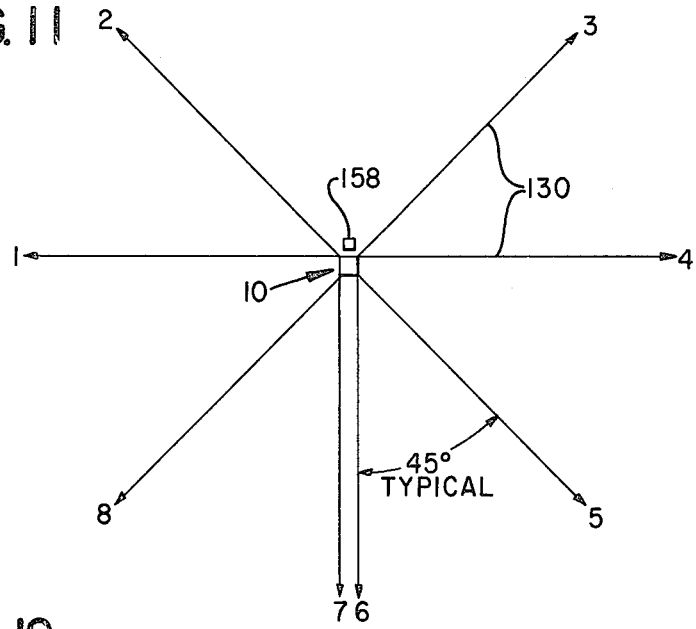
FIG. 11 is a plan view which illustrates the preferred mooring line arrangement of FIG. 10.

The mooring system generally comprises eight 30,000 pound LWT-type anchors. Two anchors are disposed at each corner, each with 4700 feet of three inch wire line 130 as illustrated in FIG. 1 of the drawing. The principal components of each anchor assembly include a winch 128, mooring line 130, an anchor rack 132, a pendant line 134 and an anchor marker buoy 136. An anchor pattern buoy 138 and its associated pendant line 140 are also provided for use during the deployment of anchors 142 as illustrated in FIGS. 10 and 11 of the drawing. The mooring system is normally intended for anchoring in water depths up to 700 feet.

The mooring lines 130 are played out by means of the double drum winches 128. The drum of each winch is capable of spooling 4700 feet of three-inch wire. Each winch 128 is provided with a local control panel and a remote control panel in both the forward and aft control rooms. For directly supervised manual operation of the anchor winches, a fully equipped, weather enclosed, local control station is located at each double drum winch location. This local control console is equipped to allow full performance operation of either drum of the winch by one operator. Remote control of winches is also possible by two nearly identical winch remote control consoles, one of these consoles being located in the forward control room in the crane tub, and the other being located in the aft control room. Combined operations with winches and thrusters are facilitated by the side-by-side location of winch remote control consoles and thruster control consoles in both fore and aft control rooms.

Figure 12:
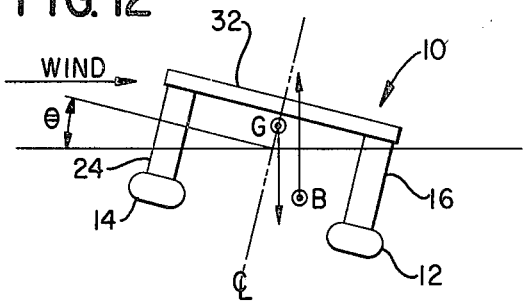
FIG. 12 is a diagram which illustrates th stability parameters of the semi-submersible vessel of FIG. 1.
Figure 13:
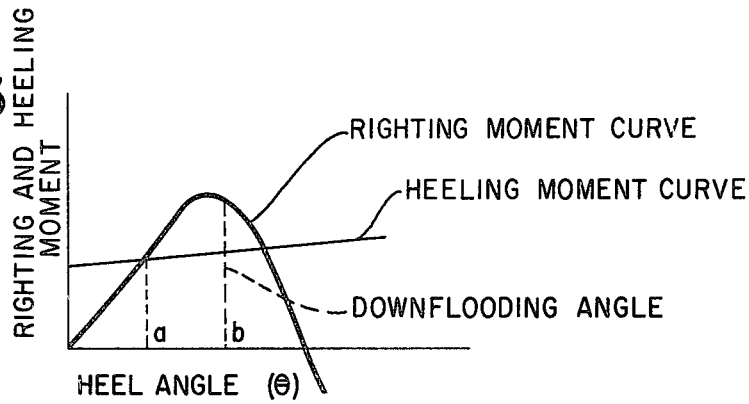
FIG. 13 is a graphical illustration of the interrelationship of the stability parameters of FIG. 12.
Figure 14C:
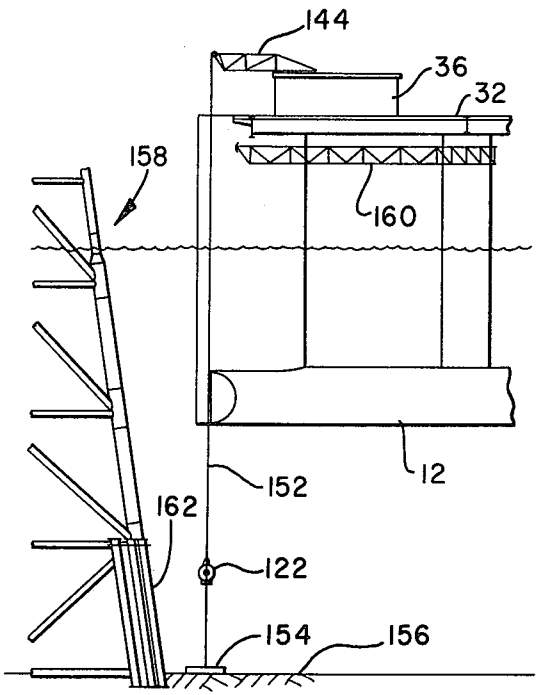
FIGS. 14 A–F illustrate a preferred diving system operating sequence.
Figure 14B:
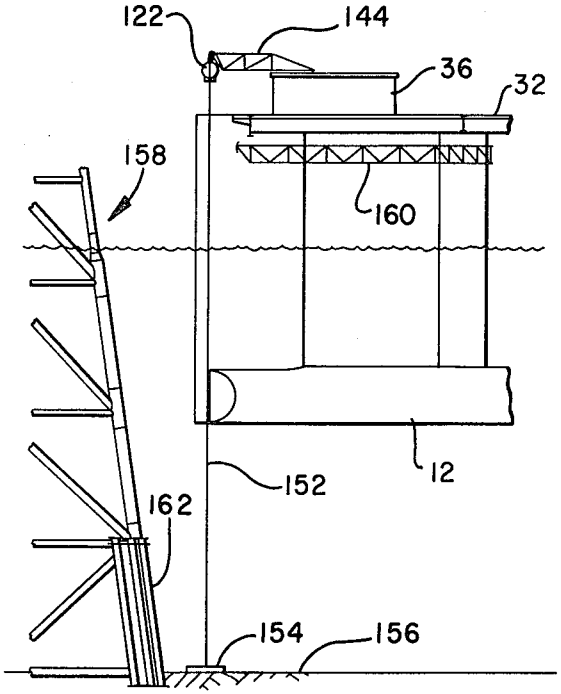
Figure 14A:
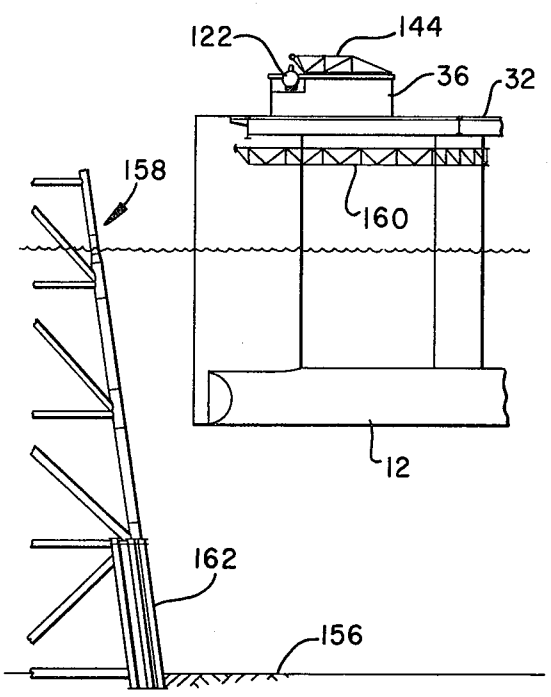
Figure 14F:
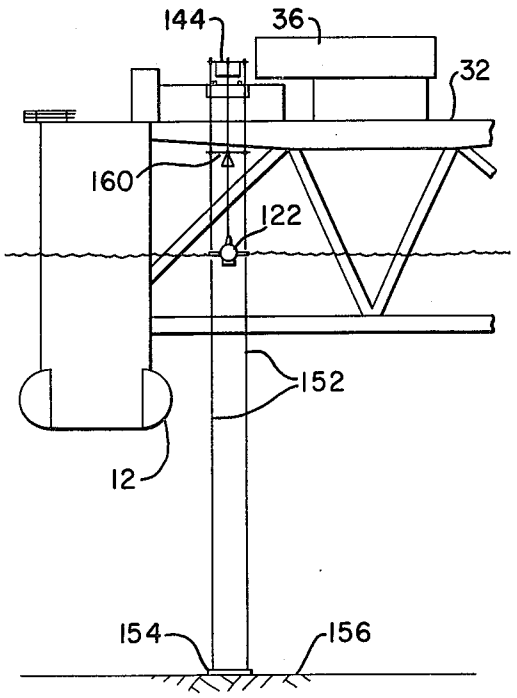
Figure 14E:
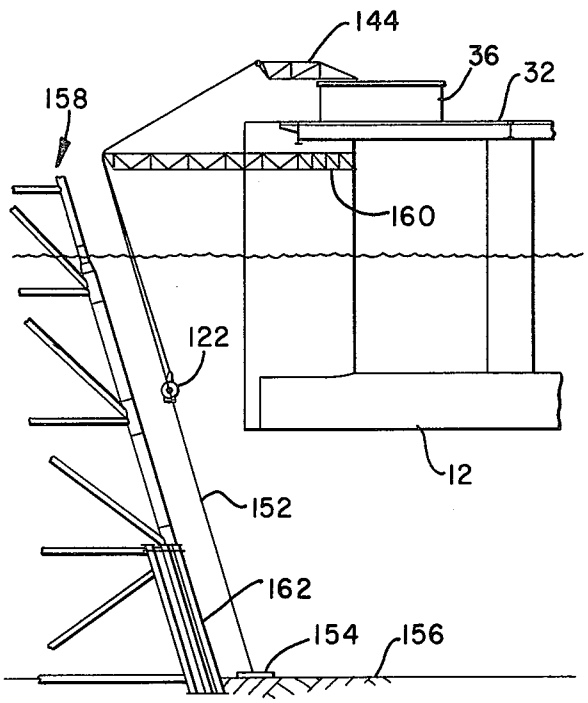
Figure 14D:
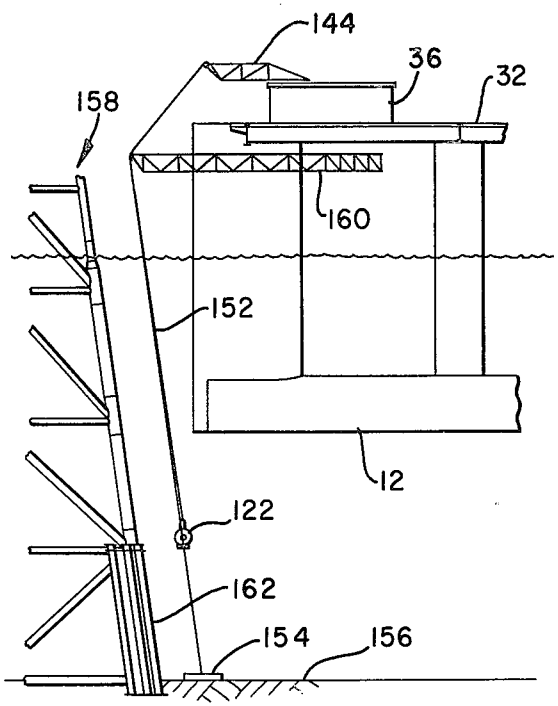

Referring now to FIGS. 12 and 13, the stability of the semisubmersible service vessel 10 is measured by its tendency to return to the upright position after being heeled over by some external force. A diagram of the vessel 10 under the influence of a beam wind is illustrated in FIG. 12. In that figure, G represents the center of gravity of the vessel, and B is the center of the underwater volume, known as the center of buoyancy. The weight of the vessel acts downward through G, and the buoyancy of the water acts upward through B. These two equal forces acting through opposite directions, create a "righting moment" which opposes the "heeling moment" created by the wind force and the resistance of the mooring lines or thrusters. When the rig is floating upright, there is no righting moment since G and B are on the same vertical line (vessel center line). As the vessel heels, the righting moment is created by the side ways shift of B. This righting moment increases to a maximum at some heel angle, then decreases as shown by the righting moment curve illustrated in FIG. 13. The heeling moment is also shown in FIG. 13. When the vessel heels to an angle (a), the righting moment equals the heeling moment and the vessel remains at this angle. If dynamic or other forces cause the vessel to heel to the down flooding angle (b), the vessel would be in danger of successive flooding of compartments. Safe operation requires that the righting moment curve be sufficiently higher than the heeling moment curve to prevent such excessive angles of heel, and the strategic locations of the principal components of the service vessel, such as the location of the heavy load lifting crane 36, the pedestal cranes 50, 52 and the aft deck house are selected to be consistent with maximum stability of operation of the service vessel 10. For this reason, the location of the principal operating elements of the service vessel relative to each other permit the service vessel 10 to be used for a variety of applications and in relatively severe ocean environments.

A substantial change in the location of any of the principal operating elements of the service vessel 10 will either diminish the operating stability of the vessel or impair its ability to perform its various functions of load lifting, fire fighting and other service operations connected with offshore platforms. For example, referring to FIG. 12, if G is moved upward along the center line, the distance between G and B reduces in the righting moment becomes smaller. This causes the righting moment curve shown in FIG. 13 to move lower, indicating less stability. The various stability criteria dictate, in effect, the lower limit of the righting moment curve, and therefore an upper limit on the vertical position of G, or "VCG". Operating limitations on loading and draft provide the necessary stability against excessive motions or overturning. It has been determined analytically and through extensive tests that the locations of the major equipment and machinery which contribute to the "light ship" load as described above afford the maximum stability against excessive motions or overturning during offshore operations in rough waters and with variable deck loading associated with the offshore operations. The term "light ship" is intended to represent the hull and other items of permanent construction, machinery, mechanical equipment, piping and all other outfitting items which are more or less permanently attached to or aboard the vessel, including the large capacity revolving crane, the small capacity pedestal cranes, the anchors, thrusters, diving equipment, fire fighting equipment, and machinery and equipment located in the deck house.

Differential ballasting of the forward and aft ballast tanks and port and starboard ballast tanks permit the vessel to be trimmed to compensate for a longitudinal moment of operational loads which might otherwise compromise stability.

The two diving systems previously discussed, the air dive system and saturation dive system, are provided for general underwater inspection repair purposes. Both systems are subject to operational restraints as sea states increase and neither should be used in wave heights exceeding 25 feet for the saturation dive system and 15 feet for the air dive system.

The saturation dive support equipment and method of using this equipment is illustrated in FIGS. 14A–F and in FIGS. 8, 9 of the drawing. The principal equipment contained within the diving facility enclosure 60 is the saturation chamber 120, diving bell 122, lifeboat chamber 124, and transfer chamber 126. An extendible platform 144 on the roof of the diving enclosure 60 is fitted with two guideline hoists 146 and a main diving bell hoist 148. A stationary umbilical hoist 150 is fixed to the roof behind the extendible platform. A control van is situated on the roof adjacent to the platform and a cabin control station is mounted on the platform.

In operation, the diving bell 122 and a guideline assembly 152 is extended clear of the service vessel 10 by the upper extendible platform 144 as shown in FIGS. 14A–F. A weighted guideline base 154 is lowered to the ocean floor 156 adjacent to an offshore platform 158 which is to be inspected or repaired. The weighted guideline base 154 functions as an anchor for the guideline assembly 152. The diving bell 122 is subsequently lowered on the guideline assembly 152 and clamped off at the desired depth.

A guideline deflector truss assembly 160 is mounted underneath the main deck 32 and is extendible to move the diving bell 122 and guideline assembly 152 closer to the required work area or parallel to the sloped leg structure 162 of the offshore platform 158 while maintaining the service vessel 10 at an acceptable distance from the structure.

The diving bell 122 is launched in the saturation diving mode only after the service vessel 10 has been moored at a safe working distance from the offshore platform 158. The guideline assembly is then extended away from the forward edge of the service vessel 10 and is anchored under tension to the ocean floor. The diving bell 122 is traversed along the guideline assembly 152 to the required depth for inspection or repair of the underwater structure. The diving bell 122 is accurately positioned at a close operating range with respect to the structure by deflecting the guideline assembly 152 in parallel relationship with the sloped structure. A constant tension of approximately 3.4 kips is maintained on the guideline assembly 152 while the diving bell is lowered to the required depth.

The saturation chamber 120, transfer chamber 126 and lifeboat chamber 124 constitute life support equipment which is utilized for emergency situations. In the event of impending loss of the service vessels 10 while diving personnel are working at depth, they may be brought aboard the vessel and placed in the lifeboat chamber 124 as shown in FIGS. 8 and 9. The lifeboat chamber 124 may be removed from the diving house for transfer over the side by the main revolving crane 36, the starboard pedestal crane 52, or it may be left to float off independently. This procedure is carried out before the crane becomes inoperable due to excessive listing of the vessel.

The diving bell 122 is provided with an egress hatch 164 which is shown in FIG. 9 in coupling engagement with the transfer chamber 126. The atmosphere within the transfer chamber 126, the saturation chamber 120 and the lifeboat chamber 124 is controlled by means of a heliox transfer station 166. The heliox station includes the necessary equipment for controlling the constituency in pressure of the atmosphere in the chambers. The saturation chamber 120 is equipped with a special lock at its aft end. A special decompression chamber may be brought aboard by helicopter and connected to the saturation chamber for transfer of personnel. The special decompression chamber may then be transported to shore by helicopter. In addition, the saturation chamber may be used to treat any diver with decompression problems or injury requiring extended decompression time or medical attention.

Both the upper extendible platform 144 and the lower guideline deflector truss 160 are supported by a system of pivoted wheel trucks and side thrust rollers. Motive power is provided by a direct drive, low speed, high torque hydraulic motor with integral band brakes. Impact bumpers limit travel when fully retracted or extended. A chain drive is used to facilitate smooth operation under conditions making continuous alignment difficult.

Figure 15:
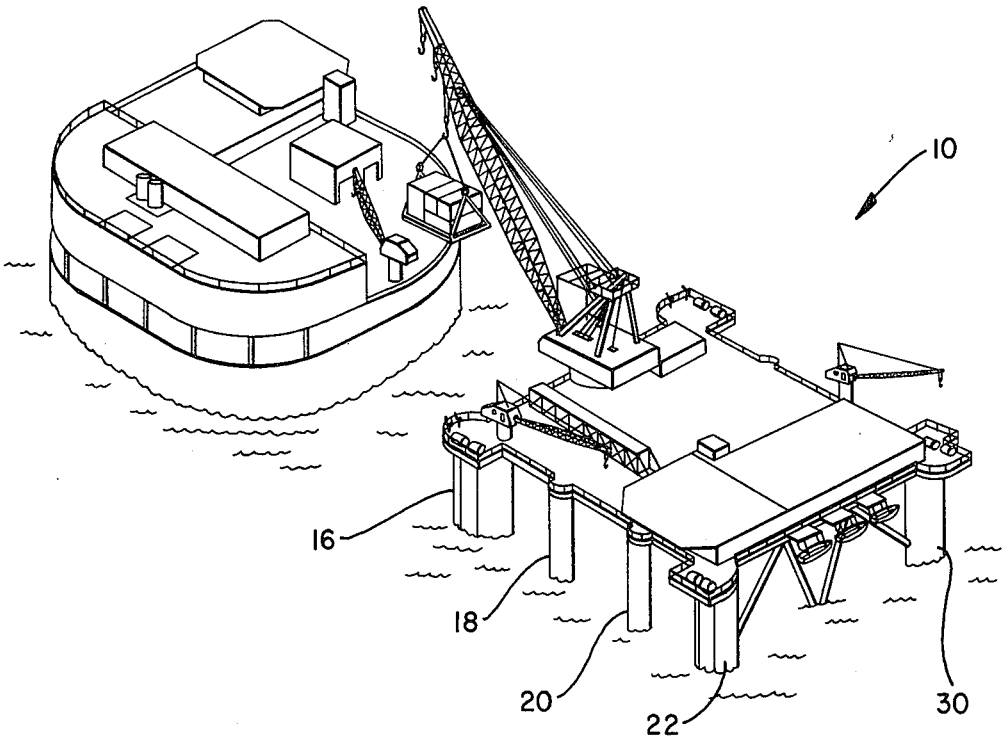
FIG. 15 is a perspective view which illustrates a typical heavy lift operation.

A typical heavy lift operation utilizing the large capacity revolving crane 36 is illustrated in FIG. 15 of the drawing. Vessel stability and the capacity of the crane boom limit the lifted load capacity. The lifting draft of the semi-submersible vessel 10 is determined by the height and clearance relationships for the particular lift. In general, as deep a draft as practical should be used when making lifts as the motions of the vessel due to wind and wave action are smaller at the deeper drafts. It has been determined that with the vessel 10 operating alongside an offshore platform or drilling unit with its anchors deployed, that it is capable of making lifts in a sea state greater than 12 feet significant wave height. The amount lifted will depend generally on the sea state, whether the vessel is working alongside a fixed platform, a semi-submersible unit or a barge. The relative motion of the two units mainly governs the amount of lifted load. In operation, the large capacity revolving crane 36 will pick a load from an offshore platform at long reach, raise the boom, rotate and set the load on the deck 32 or upon an adjacent barge. The maximum reach of the revolving crane can be extended by means of an auxiliary hook.

The built-in fire fighting facilities of the service vessel 10 offer a unique capability for the vessel to deal with offshore disasters in deep and rough waters. The approach of the service vessel 10 to any offshore fire will be dependent upon many conditions including the weather, water depth, navigational hazards. In general, if possible the approach should be made bow on from the windward side. Such an approach affords the best protection and maximum effectiveness of the on-board equipment and allows "in close" operation. If water depth permits, the stern anchor should be streamed as appropriate during approach using the anchor winch brakes to check speed and then hold position. The forward azimuth thrusters 78, 80 are used to position the bow and offset the reaction thrust that will be generated by the fire monitors when in use.

Figure 16:
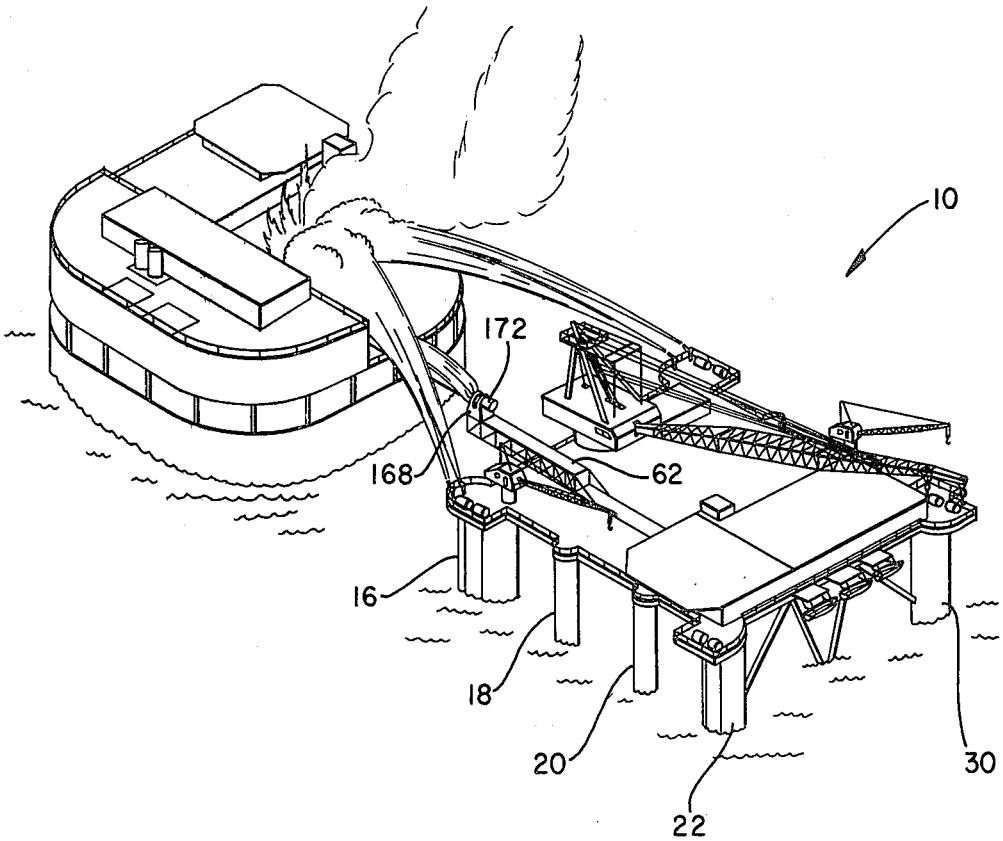
FIG. 16 is a perspective view which illustrates a typical water spray operation.
Figure 17:
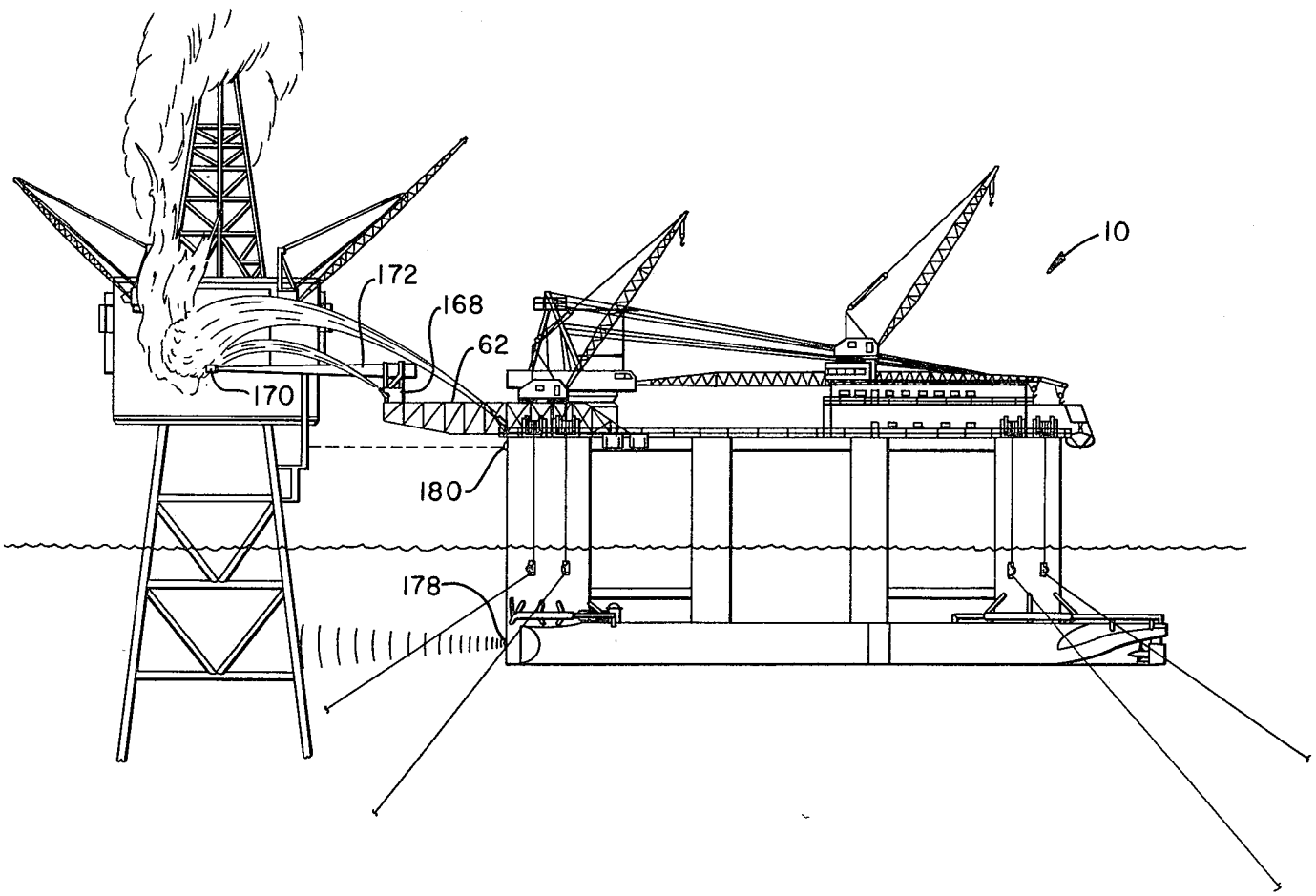
FIG. 17 is a side elevational view which illustrates a typical fire fighting operation.

An important feature of the fire fighting capability is the fire boom 62 which comprises an extendible truss which allows the semi-submersible service vessel 10 to provide fire fighting functions close to a burning structure while maintaining the vessel at a safe operating distance. The fire boom 62 includes the array of monitors 58 at its outer end from which the heated structure can be cooled and which provides heat shield protection for personnel or equipment on the boom. Typical fire fighting and water spray operations in which the boom 62 is utilized is illustrated in FIGS. 16 and 17 of the drawing. A fire vehicle 168 which is movable along the extendible boom 62 may be used to remove pieces of the burning or damaged structure, to position control valves or to place explosive charges.

The fire boom 62 is initially installed on the service vessel 10 as shown in FIG. 1 of the drawing. The boom is designed to operate extended 30 to 80 feet forward of the bow. The fire boom 62 is jacked forward to its desired position and is then bolted in place. With the fire boom bolted in place, the fire vehicle 168 may be moved toward the forward end of the fire boom. The fire vehicle 168 can be operated at any position along the boom 62. A lifting claw 170 is fastened to the end of an arm 172 to remove pieces of burning or damaged structure. It is also used to operate control valves or to position explosive charges on the burning structure. The fire vehicle 168 and the arm 172 are cooled at all times with a water spray when it is near a fire as illustrated in FIG. 16. When using the vehicle with explosives, the claw is removed from the end of the arm and a bar (not shown) is welded onto the end of the arm to support the explosive charge.

The combined function of the fire pumps, manifolds and monitors is to provide water as an extinguishing agent and as a cooling medium in adequate amounts to the most effective areas. According to an important feature of the invention, the fire pumps, manifolds and monitors in combination with an array of heat shield spray nozzles 174 cool the diving houses, pressure vessels and forward stability columns as shown in FIGS. 18A and 18B. To accomplish this function, each monitor is capable of 180° rotation with the manual lock and bypassable limit which will allow 360° rotation. Each monitor is also capable of rotation to 70° in elevation above horizontal and 20° below horizontal with manual lock. A butterfly valve is provided for regulating the water supply. The function of this equipment when operating as a heat shield system is to provide protection for personnel, vessel and equipment from heat and fire during an off-vessel fire fighting operation. The heat shield system comprises the heat shield spray nozzles 174 strategically located over the entire forward parts of the vessel including the fire boom and cranes. Each nozzle produces a spray pattern 175 as shown in FIG. 18B. Heat sensitive thermocouples 176 (FIG. 2) are installed on the forward parts of the vessel with indicators in the forward control room and alarm bells at set points in the after control room. The purpose of the thermocouples is to evaluate heat exposure forward to determine the safe distance from the fire during fire fighting operations.

The heat exposure of the forward stability columns 16, 24 must be limited because of the risk of heat induced stress, buckling or collapse of a column. It may be desirable to monitor the temperature of the fore and aft surfaces of each forward stability column to establish a reference temperature level and for determining the temperature differential of the forward surfaces relative to the after surfaces. It has been determined that at an operating draft of fifty feet or more, the stability columns can tolerate a 200° F. temperature differential, but only 100° F. differential at minimum draft.

During a firefighting operation, the buoyancy control feature of the hulls and stability columns is employed in combination with the anchor line winch control features and thrusters to provide vertical (elevation) and azimuth stability. This permits the service vessel 10 to "stand off", clear debris, and position an explosive charge, if necessary, to blow out a platform fire. The monitors are used to focus water on the boom to protect the boom and explosive charge.

The monitor arrays 54, 56 and 58 may also be utilized to discharge a foam dispersant or detergent solution onto the ocean surface for oil spill containment operations.

Effective mooring and station keeping procedures are essential for the various operations of the semi-submersible service vessel 10. When mooring adjacent to a fixed offshore platform, the mooring arrangement should resemble the one illustrated by FIG. 11. Two anchors designated by the numeral 6 and 7 in the drawing are dropped on approach to the site. They are the critical anchors because they provide the restraint to the vessel 10 that prevents collision with the fixed platform 158. Anchors 5 and 8 function to resist lateral motion and also restrain motion toward the fixed platform. Anchors 1 and 4 restrain lateral motion. It may be impractical to run anchors 2 and 3 because of underwater platform structure or pipeline configurations. If they are run, these two anchors resist forces due to tensions in the anchor lines 6 and 7, and any environmental forces tending to move the vessel away from the fixed platform 158.

If anchors 2 and 3 cannot be run, it is advantageous to moor on the windward side of the platform so that wind forces acting on the semi-submersible service vessel 10 produce tension in the anchor lines 6 and 7. In the absence of sufficient wind, the main propulsion screw propellers 78, 80 must be used to put the anchor tension (about 50 to 125 kips) or the vessel will tend to surge back and forth excessively.

Mooring on the windward side of a fixed platform will also aid helicopter landings on the fixed platform, and will place the service vessel upwind of any operating flare. It is important that the planned pattern be as symmetrical as possible so that the final moored heading of the vessel will be easy to predict. If the pattern is highly asymmetric, proper vessel orientation may compromise mooring integrity by requiring excessive tensions in some lines and too little tension in others.

The offshore platform will be approached in accordance with preplanned marker buoy placement with the vessel self-propelled. Navigation should be accomplished visually and with radar until within approximately 2,000 feet of the platform. At this time a sonar docking system 178 is activated for determining range to underwater structure and a lasar ranging system 180 is activated to determine distance to structure projecting out of the water, as illustrated in FIG. 17. The sonar system 178 is sensitive enough to detect a six-inch pipe at 1,000 feet and measure the distance of the pipe from the lower hulls to plus or minus one foot accuracy. The laser system 180 is accurate to plus or minus one inch at 500 foot range. Both systems continuously monitor and alarm if any preset distance variance is exceeded.

Anchors, pendant lines and buoys are transferred by work boats according to conventional launching procedures.

Although preferred embodiments of the invention have been described in detail, it should be understood that various changes, substitutions, and alterations can be made therein without departing from the spirit and scope of the invention as defined by the appended claims.

What is claimed is:

1. A semi-submersible service vessel comprising, in combination:

a service platform having forward, aft, port and starboard sides from which marine service operations may be performed;

first and second elongate hull structures disposed subjacent the service platform, each hull having a ballast tank enclosed therein for controlling the buoyancy of each hull, respectively;

a plurality of buoyant stability columns vertically disposed intermediate each hull and the service deck at forward and aft locations;

a truss system mechanically interconnecting the hulls and service deck for supporting the hulls in spaced parallel relation and for supporting the service deck in a fixed elevated position with respect to the hulls;

means for selectively adding or removing ballast to the ballast tanks of each hull structure;

first propulsion means disposed in the aft region of each hull for producing a driving thrust in a direction parallel with the longitudinal axis of the hull;

second propulsion means disposed in the forward region of each hull for producing a steering thrust, the second propulsion means being mounted for controlled movement relative to an axis of revolution for producing a steering thrust in a direction which may be varied in azimuth;

a plurality of anchor lines reeved for deployment from each corner of the vessel;

a winch assembly connected to each anchor line for maintaining a predetermined level of tension in each line, a sonar ranging system for measuring the underwater distance between a submerged portion of the service vessel and a submerged portion of an offshore platform; and a laser ranging system for measuring the above water distance between the elevated portion of an offshore platform and an elevated portion of the service vessel.

2. A self-propelled semi-submersible service vessel for tending petroleum production or drilling operations performed upon an offshore platform, said service vessel including a service deck from which marine service operations may be performed; first and second elongate hull structures disposed subjacent the service deck, each hull having a ballast tank enclosed therein for controlling the buoyancy of each hull respectively; a plurality of stability columns vertically disposed intermediate said hulls and said service deck; a truss system mechanically interconnecting the hulls and service deck for supporting the hulls in spaced parallel relation and for supporting the service deck in a fixed elevated position with respect to the hulls; propulsion means mounted on said hulls for producing a driving thrust which can be varied in azimuth for controlling the heading of said vessel; an anchor line assembly reeved for deployment from said vessel for mooring said vessel adjacent said offshore platform; a firefighting system including a first array of monitors disposed along an edge of the service deck for discharging streams of water upon said offshore platform while said vessel is moored alongside said offshore platform; and, an extendable fire boom mounted for projection beyond the edge of the service deck providing a work station closely adjacent to said offshore platform for assisting firefighting operations.

3. The self-propelled semi-submersible service vessel of claim 2, said firefighting system including:

a second array of monitors disposed on the fire boom for discharging streams of water upon said offshore platform in cooperation with said first array of monitors.

4. The self-propelled semi-submersible service vessel of claim 2, said extendable fire boom including:

a fire vehicle mounted for movement along the length of said fire boom; and a utility arm attached to the fire vehicle for reaching a desired location on said offshore platform.

5. The self-propelled semi-submersible service vessel of claim 4, said utility arm including:

a utility claw attached to the end of said utility arm for forcibly removing structural components of said offshore platform during a firefighting operation.

6. The self-propelled semi-submersible service vessel of claim 2, said firefighting system including:

an array of spray nozzles arranged along the edge of said service deck and stability columns operably connected to discharge a curtain of water between said service vessel and said offshore platform for thermally shielding said service deck and said stability columns.

7. The self-propelled semi-submersible service vessel of claim 2, said firefighting system including heat responsive transducers mounted on forward portions of said stability columns for detecting an overheat condition.

8. The self-propelled semi-submersible service vessel as defined in claim 2, said firefighting system including:

a fire pump operably connected to charge said monitors with sea water, said fire pump being disposed in a compartment defined by the union of a selected one of said stability columns and said hull structure to which said selected column is attached.

9. The self-propelled semi-submersible service vessel as defined in claim 2, said combination including a winch assembly coupled to each anchor line for maintaining a predetermined level of tension in each line in cooperation with the propulsion means for station keeping during firefighting operations.

10. A semi-submersible service vessel comprising, in combination:

a service platform having forward, aft, port and starboard sides from which marine service operations may be performed;

first and second elongate hull structures disposed subjacent the service platform, each hull having a ballast tank enclosed therein for controlling the buoyancy of each hull, respectively;

a plurality of buoyant stability columns vertically disposed intermediate each hull and the service deck at forward and aft locations;

a truss system mechanically interconnecting the hulls and service deck for supporting the hulls in spaced parallel relation and for supporting the service deck in a fixed elevated position with respect to the hulls;

means for selectively adding or removing ballast to the ballast tanks of each hull structure;

first propulsion means disposed in the aft region of each hull for producing a driving thrust in a direction parallel with the longitudinal axis of the hull;

second propulsion means disposed in the forward region of each hull for producing a steering thrust, the second propulsion means being mounted for controlled movement relative to an axis of revolution for producing a steering thrust in a direction which may be varied in azimuth;

a plurality of anchor lines reeved for deployment from each corner of the vessel;

a winch assembly connected to each anchor line for maintaining a predetermined level of tension in each line;

a sonar ranging system for measuring the underwater distance between a submerged portion of the service vessel and a submerged portion of an offshore platform; and, a laser ranging system for measuring the above water distance between the elevated portion of an offshore platform and an elevated portion of the service vessel.

11. A self-propelled semi-submersible vessel for tending an adjacent offshore petroleum production or drilling platform comprising, in combination:

a service deck for performing marine service operations;

means cooperatively disposed below said service deck for controlling the buoyancy of said vessel, thereby controlling the elevation of said service deck with respect to sea level;

a firefighting system including means for discharging streams of water upon said offshore platform and means controllable from said service deck for assisting firefighting operations on said platform;

said water discharging means being characterized by a first array of monitors disposed along an edge of said service deck; and, said firefighting assisting means being characterized by an extendable fire boom mounted for projection beyond said service deck for providing a work station closely adjacent to said offshore platform.

12. The self-propelled semi-submersible vessel of claim 11, said firefighting system including:

a second array of monitors disposed on said fire boom for discharging streams of water upon said offshore platform in cooperation with said first array of monitors.

13. The self-propelled semi-submersible vessel of claim 11, said extendable fire boom including:

a fire vehicle mounted for movement along the length of said fire boom; and, a utility arm attached to said fire vehicle for reaching a desired location on said offshore platform.

14. The self-propelled semi-submersible vessel of claim 13, said utility arm including:

a utility claw attached to the end of said utility arm for forcibly removing structural components of said offshore platform during a firefighting operation.

* * * * *